US005344121A

United States Patent [19]

Baziuk

[11] Patent Number: 5,344,121

[45] Date of Patent: Sep. 6, 1994

[54] SAFETY WINCH

[76] Inventor: Morris Baziuk, Box 53, Group 6, R.R. #1, Winnipeg, Manitoba, Canada, R3C 4A3

[21] Appl. No.: 221

[22] Filed: Jan. 4, 1993

Related U.S. Application Data

[63] Continuation-in-part of Ser. No. 680,996, Apr. 5, 1991, abandoned.

[51] Int. Cl.[5] ..... B66D 3/16

[52] U.S. Cl. ..... 254/358; 254/366; 254/368; 254/375

[58] Field of Search ..... 254/358, 366, 368, 375, 254/376, 294, 311; 242/86.5 A

[56] References Cited

U.S. PATENT DOCUMENTS

| | | | |
|---|---|---|---|
| 485,515 | 11/1892 | Uhlig | 254/339 X |
| 2,282,634 | 5/1942 | Young | 254/358 X |
| 2,339,449 | 1/1944 | Ashton | 254/358 X |
| 2,351,654 | 6/1944 | Anderson . | |
| 2,356,371 | 8/1944 | Anderson | 254/311 X |
| 2,630,298 | 3/1953 | Hoehn . | |
| 2,690,240 | 9/1954 | Schroeder | 254/358 X |
| 2,703,162 | 3/1955 | Keim et al. | 254/358 X |
| 3,776,514 | 12/1973 | Eggleton, Jr. et al. | 254/375 |
| 4,046,235 | 9/1977 | Shutt | 254/356 X |
| 4,438,904 | 3/1984 | White | 254/311 |
| 4,664,357 | 5/1987 | Nishimura | 254/903 X |

*Primary Examiner*—Daniel P. Stodola
*Assistant Examiner*—Michael R. Mansen
*Attorney, Agent, or Firm*—Adrian D. Battison; Stanley G. Ade; Murray E. Thirft

[57] ABSTRACT

A winch, for example, for winding in and paying out a cable attached to a person in a hazardous situation, for example underground, comprises a pair of axles mounted on a frame, one of the axles carrying the cable drum for rotation therewith. Two safety brakes are provided, one on each axle, and each including a cam actuated clutch so that rotation of the drum in the pay-out direction is only allowed when the axles are driven in the pay-out direction. A handle for driving the axles includes two hand grasp portions for different mechanical advantage. The handle can be located at two different positions on a drive sprocket on one of the axles or on a second drive sprocket freely rotatable on the first axle for different drive ratios.

7 Claims, 2 Drawing Sheets

SAFETY WINCH

This is a continuation-in-part of application Ser. No. 680,996, filed Apr. 5, 1991, now abandoned.

BACKGROUND OF THE INVENTION

This invention relates to a safety winch of a type particularly, but not exclusively designed for paying out and reeling in a cable attached to a person when entering a hazardous zone so the person can be extracted by the winch if necessary.

It is well known that persons entering hazardous situations such as underground pipelines, storage containers and the like can encounter difficulties such as poisonous fumes which can place the person in difficulty or even causing unconsciousness. In such a situation it is necessary for the person to be extracted from the danger without the necessity of a second person entering the same zone and possibly befalling the same fate.

As safety consciousness has developed, therefore, it has been necessary to attach to persons entering such a zone a cable attached to a harness worn by the person with the cable extending to a suitable hoist system which allows the cable to be reeled in and the person extracted from the dangerous situation. Many winches are available which provide sufficient power to allow the person to be extracted including lifting the person vertically, should this be necessary. Hand winches of this type are available which can develop sufficient force from hand operation to withdraw the person. These winches generally include a brake mechanism so that the cable is prevented from being rapidly paid out should the winch be inadvertently released, for example when lifting the person from an underground location. It will of course be appreciated that, should the winch be released or the brake fail, the person can be dropped with the possibility of causing injuries beyond those already sustained.

Conventional winches are therefore unsatisfactory as they do not provide sufficient fail safe operation and such they do not have the flexibility of drive arrangements to enable the winch to be operated in a manner which avoids interfering with the normal operation of the person while in the dangerous location but yet provides the ability to extract the person and to generate sufficient power to ensure that the person can be properly lifted.

According to the a first aspect of the invention there is provided a safety winch comprising a main frame, a cable, a main axle, a secondary axle, means mounting the main axle and the secondary axle on the main frame each for rotation about a respective one of two parallel axles, a drum mounted on the main axle for rotation therewith in a first direction to cause pay-out of said cable and in a second direction to cause reel in of said cable, chain drive means for communicating rotation of each of the main axle and the secondary axle to the other of the main axle and the secondary axle, handle means for manually driving the secondary axle, and a safety brake arrangement operable to prevent rotation of the main axle in said first direction, the safety brake arrangement comprising first safety brake means mounted on the main axle and second safety brake means mounted on the secondary axle, each of the first and second safety brake means being arranged to allow rotation of the main axle in said second direction to cause reel in of the cable and being arranged to prevent rotation of the main axle in said first direction except when the main axle is driven from said chain drive means in said first direction.

According to a second aspect of the invention there is provided a safety winch comprising a main frame, a cable, a main axle, a secondary axle, means mounting the main axle and the secondary axle on the main frame each for rotation about a respective one of two parallel axes, a drum mounted on the main axle for rotation therewith in a first direction to cause payout of said cable and in a second direction to cause reel in of said cable, chain drive means for communicating rotation of each of the main axle and the secondary axle to the other of the main axle and the secondary axle, handle means for manually driving the secondary axle, and a safety brake arrangement operable to prevent rotation of the main axle in said first direction, said safety brake assembly comprising a ratchet wheel mounted on the main axle for rotation about the axis of the main axle relative to the main axle, a pawl mounted on the frame and cooperating with the ratchet wheel to prevent rotation thereof in said first direction, a drive member receiving drive from said chain drive means and mounted on the main axle for rotation about the axis of the main axle, friction pad means between the drive member and the ratchet wheel and cam means between the main axle and the drive member allowing limited rotational movement between the main axle and the drive member and operable in said second direction of movement of the drive member to cause the friction pad means to form a frictional connection between the drive member and the ratchet wheel to communicate drive from the drive member to the ratchet wheel and operable in said first direction of movement of the drive member to move the friction pad means axially to separate said frictional connection to allow rotation of the drive member and the main axle relative to the ratchet wheel.

According to the third aspect of the invention, there is provided a safety winch comprising a main frame, a cable, a main axle, a secondary axle, means mounting the main axle and the secondary axle on the main frame each for rotation about a respective one of two parallel axes, a drum mounted on the main axle for rotation therewith in a first direction to cause payout of said cable and in a second direction to cause reel in of said cable, chain drive means for communicating rotation of each of the main axle and the secondary axle to the other of the main axle and the secondary axle, handle means for manually driving the secondary axle, and a safety brake arrangement operable to prevent rotation of the main axle in the said first direction, a first sprocket mounted on the secondary axle at an end thereof opposite to said chain drive means, a drive sprocket mounted on said main frame, a chain communicating drive from the drive sprocket to the first sprocket, each of said first sprocket and said drive sprocket having means thereon for engagement with said handle means for communication of manual drive thereto from said handle means, the drive sprocket and the first sprocket being arranged such that a drive ratio between the drive sprocket and the main axle is different from a drive ratio between the first sprocket and the main axle.

One embodiment of the invention will now be described in conjunction with the accompanying drawings in which:

DETAILED DESCRIPTION

Figure 1:
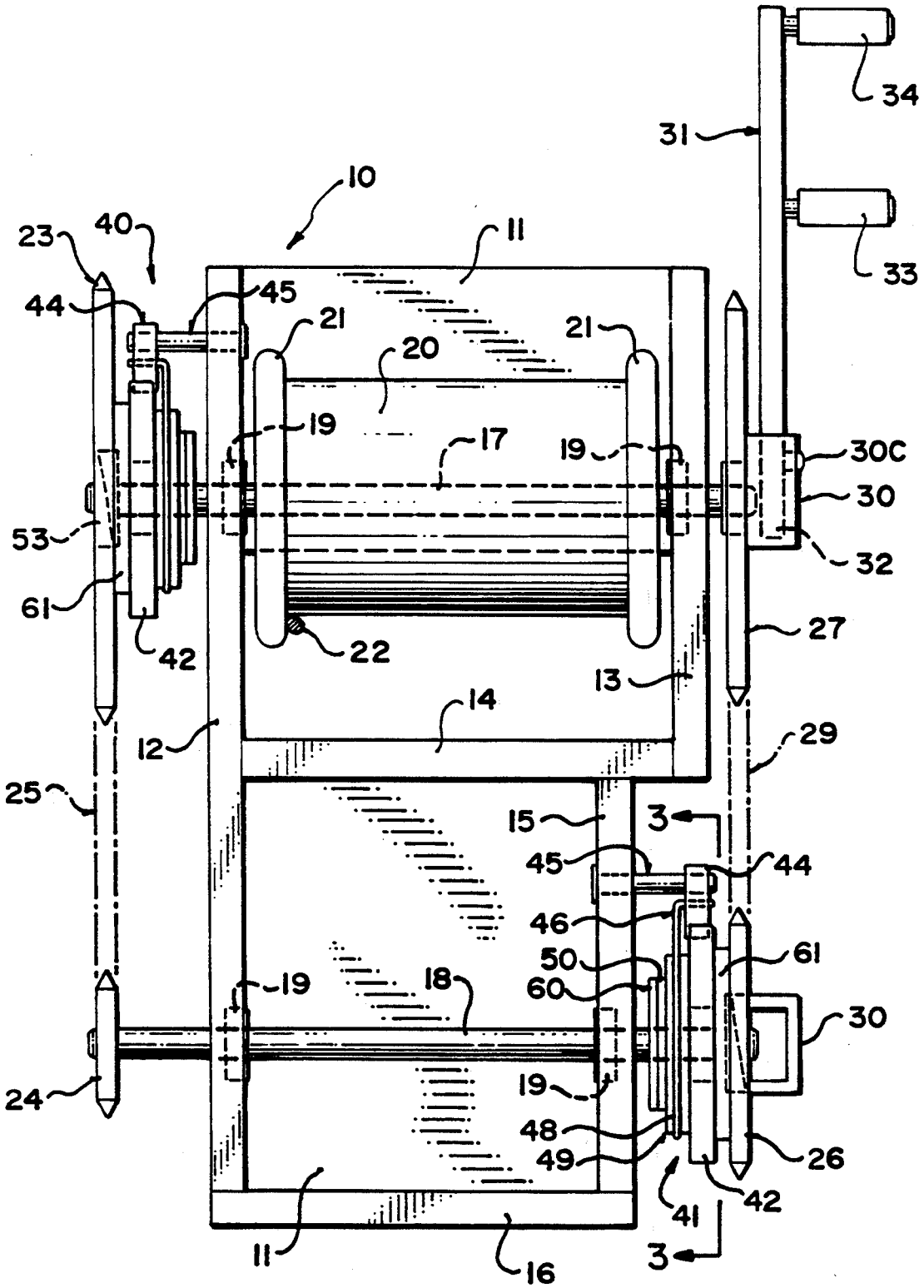
FIG. 1 is a schematic plan view of a winch according to the present invention.

The winch comprises a main frame generally indicated at 10 including a base plate 11 and a plurality of upstanding walls. The upstanding walls include a first side wall 12 extending along the full length of one side of the base frame 11. A second side wall 13 lies parallel to the first side wall and extends along the base plate to a position approximately midway along the base plate at which it is connected to a transverse wall 14. A further side wall portion 15 extends from the transverse wall parallel to the side wall 12 but spaced inwardly from the side wall portion. 13. An end wall 16 parallel to the transverse wall 14 closes the frame.

Figure 2:
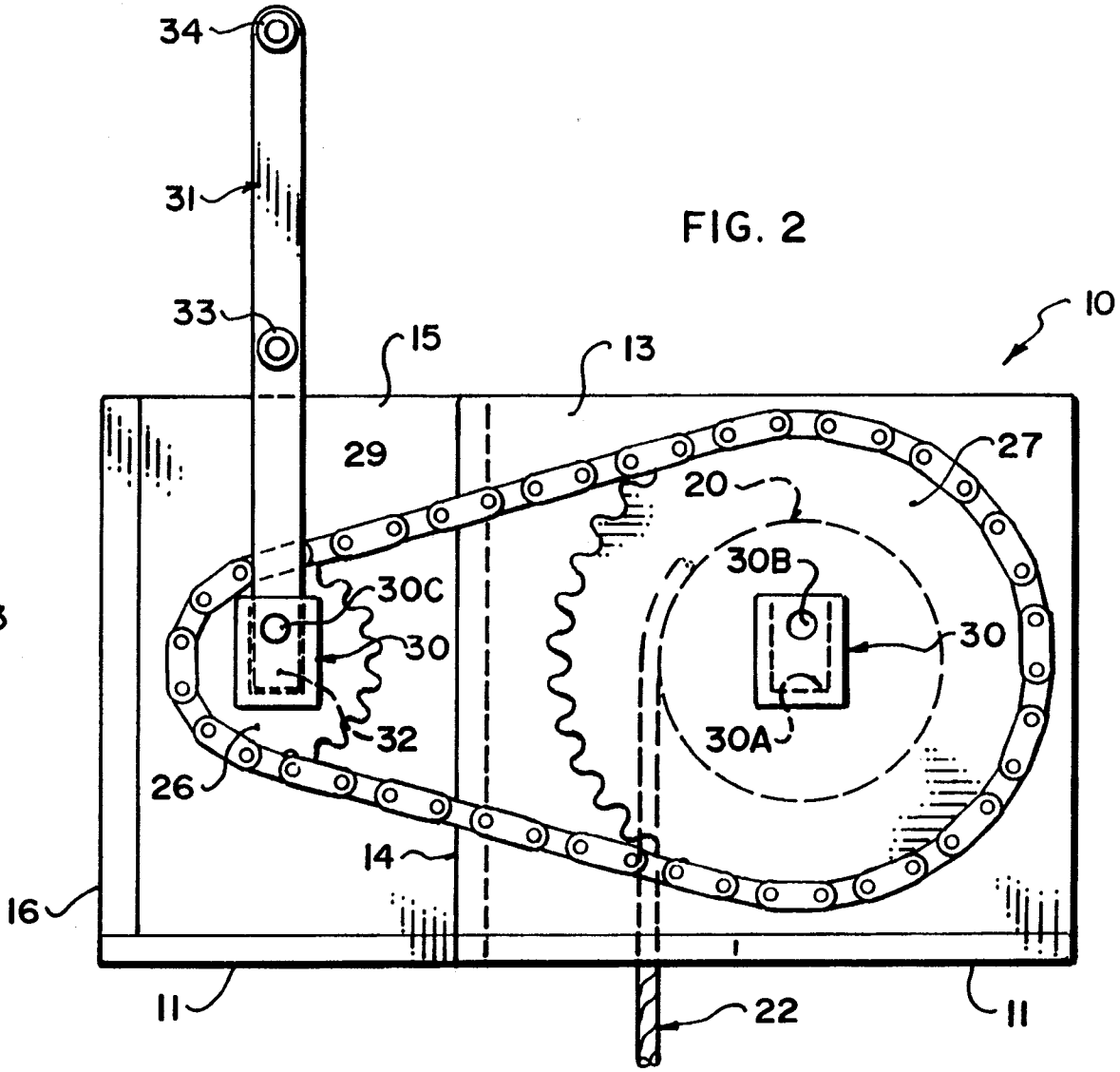
FIG. 2 is a front elevational view of the winch of FIG. 1 showing the handle attached to the second operating location.

Across the frame is provided a first main axle 17 and a secondary axle 18 which lie parallel, horizontal and parallel to the transverse wall 14. Each of the axles is support on bearings 19 mounted in the respective side walls. The main axle 17 thus is positioned on one side of the transverse wall 14 and a secondary axle 18 is positioned on the other side of the transverse wall 14. The main axle 17 carries a cable drum 20 with end walls 21 defining a cylindricl receptacle for a cable 22 to be wound thereon. The cable is arranged and attached to the drum so that the rotation of the drum in the clockwise direction as shown in FIG. 2 causes the cable to be wound onto the drum and rotation of the drum in the counter clockwise direction causes the cable to be paid out.

On the left hand end of the axle 17 is mounted a drive sprocket 23 which is connected to the axle so as to communicate drive to the axle and vice versa. On the left hand end of the axle 18 is provided a second sprocket 24 which is mounted on the axle for rotation therewith. A chain 25 communicates drive between the sprockets 23 and 24. At the right hand end of the shaft 18 is provided a first drive sprocket 26 which again is attached to the axle 18 for co-rotation therewith. A second drive sprocket 27 is mounted on the shaft 17 but is carried thereon by bearings 28 which allow the sprocket to rotate freely relative to the axle 17. A chain 29 communicates drive between the sprockets 26 and 27.

On the front face of each of the drive sprockets 26 and 27 is provided a mounting bracket 30. The mounting bracket 30 is arranged to receive a removeable handle 31 so this can be attached to a selected one of the brackets 30, removed from that bracket and replaced on the other of the brackets as required. The handle 31 includes an end portion 32 for attachment to the bracket 30 so that the end portion 32 rotates about the axis of the respective axle. The handle thus extends radially outwardly from the axle and provides a first hand grip portion 33 at a first distance spaced from the axle and a second hand grip portion 34 at a second greater distance from the axle. Thus the operator can grasp the hand grip portion 34 which requires a larger arc of rotation of the hand while driving the handle. This provides greater mechanical advantage and thus allows the operator to apply a greater force. The hand grip portion 33 being positioned radially inwardly requires only a much shallower arc of the movement of the hand with a significantly reduced mechanical advantage for high speed drive of the handle. The bracket 30 includes a slot 30A parallel to the end of the handle for receiving the end therein. The outer face of the slot 30A has a hole 30B through which a spring mounted pin 30C on the handle can project to lock the handle end 32 within the slot.

In addition, the sprockets 23, 24, 26 and 27 have different numbers of drive teeth so as to provide a different drive ratio when the handle is applied to the sprocket 26 as opposed to the drive ratio when the the handle is applied the sprocket 27. Thus in one example the sprocket 27 has 38 teeth and the sprocket 26 has 19 teeth providing a drive ratio of 2 to 1. The sprocket 24 in this example has 10 teeth and the sprocket 23 has 40 teeth providing a ratio of 4 to 1. Thus when the handle is applied to the sprocket 26, the drive ratio from the handle to the axle 17 is governed wholly by the sprockets 24 and 23 and thus is at a ratio of 4 to 1. When the handle is applied to the sprocket 27, the ratio of drive from the handle to the axle 17 is 2 to 1 since the ratio is reduced from the sprocket 27 to the sprocket 26 and then increased from the sprocket 24 to the sprocket 23. The mounting of the sprocket 27 on the axle 17 does not provide any drive communication between those elements except through the drive chain as described above, but provides a convenient location for mounting the sprocket 27 in a limited space since the sprockets 27 and 23 are then aligned allowing the outer housing to be maintained at a minimum.

In order to provide yet further flexibility for the drive system, with the handle removed,.a chain drive pulley of the type used in overhead doors can be used and mounted on the bracket 30. This provides therefore a chain suspended from the chain drive pulley so the chain can be pulled over the pulley to apply a drive action to the required sprocket through the bracket 30.

In a yet further arrangement, a bevelled gear drive arrangement can be connected to the bracket 30 with the bevel gear receiving drive from a second bevel gear mounted on the end plate 16 and attached to a handle. In this way the handle can rotate about an axle at right angles to the axles 17 and 18 so that the device can be driven from that position when required.

In order to prevent inadvertent release of the cable when fully wound in or while winding or paying out of the cable, there are provided a first and a second safety brake arrangement 40, 41. The safety brake arrangement 40 is mounted on the axle 17 and cooperates with the frame adjacent the axle 17 so as to halt rotation of the axle in a pay out direction. the second safety brake arrangement 41 acts as a back-up to the first safety brake arrangement in case of a failure of the first. In operation, as will be apparent from the description hereinafter, the first safety brake arrangement is that which is normally operating while the second safety brake arrangement is normally released in the pay-out operation.

The safety brake arrangements are substantially identical and each comprises a ratchet wheel 42 having ratchet teeth 43. The ratchet teeth cooperate with a pawl 44 mounted on a shaft 45 pivotally attached to the frame adjacent the ratchet wheel. The pawl 44 is shaped to engage into the ratchet teeth to prevent rotation of the ratchet wheel 42 in a direction to hold the ratchet wheel against rotation in the pay-out direction. Thus as viewed from the adjacent end of the shaft 18, the ratchet wheel 42 is prevented from rotating in the counter clockwise direction. As viewed from the adjacent end of the axle 17, the ratchet wheel 42 is prevented from rotating in a clockwise direction.

Figure 3:
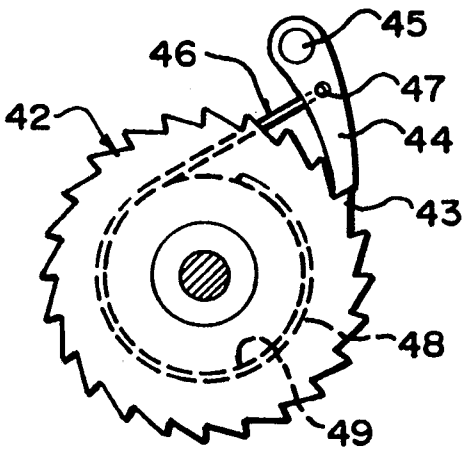
FIG. 3 is a view along the lines 3—3 of FIG. 1 showing the construction of the ratchetk and pull arrangement.

The pawl 44 is actuated from the engaged position shown in FIG. 3 to a release positioned spaced away from the ratchet teeth 43 by a spring wire 46 which has an end hook portion 47 engaged through a hole in the pawl 44. The spring wire 46 includes a circular hoop portion 48 which is wrapped around a drum 49 attached to and co-rotating with the ratchet wheel 42. Thus it will be appreciated that rotation of the ratchet wheel in the clockwise direction a shown in FIG. 3 causes the spring hoop 48 to be rotated by the drum 49 in a direction to push the pawl away from the ratchet teeth to allow the rotation of the ratch wheel in the clockwise direction to continue without the pawl riding over the ratchet teeth. Rotation of the drum in the counter clockwise direction causes the hoop 48 to pull the spring in the counter clockwise direction pulling the pawl into engagement with the ratchet teeth to engage into the ratchet position.

Each of the ratchet wheels is mounted on its respective axle by bearings allowing free rotation between the axle and the ratchet wheel. The ratchet wheel is however engaged with the axle through a friction pad 50 carried on the face of the ratchet wheel between the ratchet wheel and a plate 60 fixed on the axle on the inside of the ratchet wheel. A second friction pad 61 is located between the outer face of the ratchet wheel and the inside face of the adjacent drive sprocket. The ratchet wheel, brake pad 50 and 61 and the drive sprocket are normally frictionally interconnected into engagement so that normally the ratchet wheel is attached to the respective axle for co-rotation therewith. Thus the pawl and ratchet arrangement normally allow the rotation of the axles in a direction to wind up the cable onto the drum but prevent rotation of the axles in the opposed direction to allow pay-out of the cable.

In the event therefore that the handle is released during wind-up of the cable or the cable is pulled, for example by a fall of the person attached to the cable, then the cable is prevented from being pulled out by the ratchet wheel and the pawl mounted on the axle 17.

In order to pay out the cable, therefore, it is necessary to release the brake end this is effected by rotation of the sprocket 23 in a direction to pay out the cable. Between the sprocket and the ratchet wheel is provided a cam drive arrangement 53 which allows limited rotation of the sprocket relative to the ratchet wheel. As the sprocket is thus driven in the direction to pay out the cable, the sprocket moves relative to the ratchet wheel, as the ratchet wheel is held, and the cam drive member 53 pushes the ratchet wheel away from the sprocket to release the brake action between the friction pad 61 and the inside surface of the sprocket and between the friction pad 50 and the fixed plate 60. As soon as the friction coupling is relesed, the sprocket and the axle together with the drum are free to rotate in the pay-out direction allowing the pay-out action to take place.

However, as soon as movement occurs between the axle and the sprocket, this causes the cam member 53 to re-engage the friction brake pads to hold the axle and and therefore the drum against further movement. The rotation of the drum is thus limited to the amount of rotation of the drive sprocket and automatically prevents any further rotation beyond that deliberately applied by the operator.

The same effect is carried out at the secondary safety brake 41 but because of the increased drive ratio at the second safety brake, this release of the friction pad from the sprocket 26 occurs earlier and to a greater extent so that the main control of the movement of the drum is carried wholly by the first safety brake 40.

The drive arrangement for the drum and the safety brake arrangement including the secondary safety brake, provide a highly effective arrangement for winding and paying out the cable while at all times prevent the cable from being released rapidly. The device is therefore particularly useful for attachment to a person in a hazardous location, for example underground, so that the person can be pulled in by the winch arrangement including lifting the person from an underground location without any danger of the person being dropped should the winch be inadvertently released. The device does not in any way rely upon a single pawl and thus provides a fail-safe arrangement necessary for the protection of human life.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A safety winch comprising a main frame, a cable, a main axle, a secondary axle, means mounting the main axle and the secondary axle on the main frame each for rotation about a respective one or two parallel axes, a drum mounted on the main axle for rotation therewith in a first direction to cause pay-out of said cable and in a second direction to cause reel in of said cable, chain drive means for communicating rotation of each of the main axle and the secondary axle to the other of the main axle and the secondary axle, the chain drive means including a first sprocket mounted on the main axle at one end thereof for rotation about the axis of the main axle, a second sprocket mounted on adjacent end of the secondary axle for rotation about the axis of the secondary axle, a chain wrapped around the first and second sprockets, means for manually driving the secondary axle including a drive member mounted on the secondary axle at an end thereof opposite to said second sprocket for rotation about the axis of the secondary axle, and a manually graspable handle for driving said drive member, a first safety brake assembly comprising a first ratchet wheel mounted on the main axle at said first sprocket for rotation about the axis of the main axle relative to the main axle, a first pawl mounted on the frame and cooperating with the first ratchet wheel to prevent rotation of the first ratchet wheel in said first direction, first friction pad means mounted between the first sprocket and the first ratchet wheel and first cam means between the main axle and the first sprocket allowing limited rotational movement between the main axle and the first sprocket and operable in said second direction of movement of the first sprocket to cause the first friction pad means to form a frictional connection between the first sprocket and the first ratchet wheel to communicate drive from the first sprocket to the first ratchet wheel and operable in said first direction of movement of the first sprocket to move the first friction pad means axially to separate said frictional connection to allow rotation of the first sprocket and the main axle relative to the first ratchet wheel; and a second safety brake assembly comprising a second ratchet wheel mounted on the secondary axle at said drive member for rotation about the axis of the secondary axle relative to the secondary axle, a second pawl mounted on the frame and cooperating with the second ratchet wheel to prevent rotation thereof in said first direction, second friction pad means mounted between the drive member and the second ratchet wheel and second cam means between the secondary axle and the drive member allowing limited rotational movement between the secondary axle and the drive member and operable in said second direction of movement of the drive member to cause the second friction pad means to form a frictional connection between the drive member and the second ratchet wheel to communicate drive from the drive member to the second ratchet wheel to communicate drive from the drive member to the second ratchet wheel and operable in said first direction of movement of the drive member to move the second friction pad means axially to separate said frictional connection to allow rotation of the drive member and the secondary axle relative to the second ratchet wheel.

2. The safety winch according to claim 1 wherein the drive member comprises a drive member sprocket and wherein there is provided a drive member chain and a drive sprocket for driving the drive member sprocket through the drive member chain, the drive sprocket and the drive member sprocket each having means thereon for readily releasable engagement with the manually graspable handle, the drive sprocket and the drive member sprocket being arranged such that a drive ratio to the main axle when the handle is in engagement on the drive sprocket is different from a drive ratio to the main axle when the handle is on the drive member sprocket.

3. The safety winch according to claim 2 wherein the drive sprocket is mounted on the main axle for free rotation thereto.

4. The safety winch according o claim 1 wherein the handle includes an elongate handle shaft for rotation about one end of the handle shaft, a first and a second hand grasp member each mounted on the handle shaft so as to extend outwardly therefrom substantially at right angles thereto, the first hand grasp member being located at a first spacing from said one end and the second hand grasp member being spaced at a greater distance from said one end.

5. The safety winch according to claim 1 including a spring engaged around a surface of the first ratchet wheel and rotatable thereby around the axis of the main axle, the spring being arranged to engage the first pawl such that rotation of the first ratchet wheel in the second direction causes the first pawl to be moved out of engagement with the first ratchet wheel and wherein rotation of the first ratchet wheel in the first direction causes the first pawl to be moved into engagement with the first ratchet wheel.

6. A safety winch comprising a main frame, a cable, a main axle, a secondary axle, means mounting the main axle and the secondary axle on the main frame each for rotation about a respective one of two parallel axes, a drum mounted on the main axle for rotation therewith in a first direction to cause payout of said cable and in a second direction to cause reel in of said cable, chain drive means for communicating rotation of each of the main axle and the secondary axle to the other of the main axle and the secondary axle, the chain drive means including a first sprocket mounted on the main axle at one end thereof for rotation about the axis of the main axle, a second sprocket mounted on adjacent end of the secondary axle for rotation about the axis of the secondary axle, a chain wrapped around the first and second sprockets, drive means for manually driving the secondary axle including a drive member sprocket mounted on the secondary axle at an end thereof opposite to said second sprocket for rotation about the axis of the secondary axle and a manually graspable handle for driving said drive member, a safety brake arrangement operable to prevent rotation of the main axle in the said first direction, a drive sprocket mounted on the main axle for free rotation relative thereto, a chain communicating drive from the drive sprocket to the drive member sprocket, each of said drive member sprocket and said drive sprocket having means thereon for engagement with said manually graspable handle for communication of manual drive thereto from said handle, the drive sprocket and the drive member sprocket being arranged such that a drive ratio to the main axle when the handle is in engagement on the drive sprocket is different from a drive ratio to the main axle when the handle is on the drive member sprocket.

7. A safety winch comprising a main frame, a cable, a main axle, a secondary axle, means mounting the main axle and the secondary axle on the main frame each for rotation about a respective one of two parallel axes, a drum mounted on the main axle for rotation therewith in a first direction to cause payout of said cable and in a second direction to cause reel in of said cable, chain drive means for communicating rotation of each of the main axle and the secondary axle to the other of the main axle and the secondary axle, the chain drive means including a first sprocket mounted on the main axle at one end thereof for rotation about the axis of the main axle, a second sprocket mounted on adjacent end of the secondary axle for rotation about the axis of the secondary axle, a chain wrapped around the first and second sprockets, drive means for manually driving the secondary axle including a drive member sprocket mounted on the secondary axle at an end thereof opposite to said second sprocket for rotation about the axis of the secondary axle and a manually graspable handle for driving said drive member, a safety brake arrangement operable to prevent rotation of the main axle in the said first direction, a drive sprocket mounted on the main axle for free rotation relative thereto, a chain communicating drive from the drive sprocket to the drive member sprocket, each of said drive member sprocket and said drive sprocket having means thereon for engagement with said manually graspable handle for communication of manual drive thereto from said handle, the drive sprocket and the drive member sprocket being arranged such that a drive ratio to the main axle when the handle is in engagement on the drive sprocket is different form a drive ratio to the main axle when the handle is on the drive member sprocket, wherein the handle includes an elongate handle shaft for rotation about one end of the handle shaft, a first and a second hand rasp member each mounted on the handle shaft so as to extend outwardly therefrom substantially at right angles thereto, the first hand grasp member being located at a first spacing from said one end and the second hand grasp member being spaced at a greater distance from said one end.

* * * * *